US006609956B2

(12) United States Patent
Margaria

(10) Patent No.: US 6,609,956 B2
(45) Date of Patent: Aug. 26, 2003

(54) METHOD AND MACHINE FOR GRINDING COATED SHEETS OF GLASS

(75) Inventor: Pierfranco Margaria, Valgioie (IT)

(73) Assignee: Bottero S.p.A., Cuneo (IT)

( * ) Notice: Subject to any disclaimer, the term of this patent is extended or adjusted under 35 U.S.C. 154(b) by 18 days.

(21) Appl. No.: 09/991,865

(22) Filed: Nov. 21, 2001

(65) Prior Publication Data

US 2002/0068514 A1 Jun. 6, 2002

(30) Foreign Application Priority Data

Nov. 28, 2000 (IT) ..... TO2000A1112

(51) Int. Cl.[7] ..... B24B 1/00
(52) U.S. Cl. ..... 451/44; 451/57; 451/65
(58) Field of Search ..... 451/44, 57, 58, 451/65, 461, 462

(56) References Cited

U.S. PATENT DOCUMENTS 4,513,543 A 4/1985 Lawrenson et al.
5,040,342 A * 8/1991 McGuire et al. ..... 451/44
5,934,982 A * 8/1999 Vianello et al. ..... 451/44
6,325,704 B1 * 12/2001 Brown et al. ..... 451/44
6,428,390 B1 * 8/2002 Clark et al. ..... 451/11

FOREIGN PATENT DOCUMENTS

| | | |
|---|---|---|
| EP | 1167312 | 1/1902 |
| EP | 0769348 | 4/1997 |
| JP | 08197402 | 8/1996 |

* cited by examiner

*Primary Examiner*—Dung Van Nguyen
(74) *Attorney, Agent, or Firm*—Sheridan Ross PC

(57) ABSTRACT

A machine for grinding coated sheets of glass has a supporting surface for a sheet of glass for grinding, and two grinding units located on opposite sides of the supporting surface; each grinding unit having at least one first grinding wheel for grinding a portion of a peripheral edge of the sheet of glass, and a second grinding wheel for removing a portion of the layer of material coating the sheet of glass.

10 Claims, 1 Drawing Sheet

1
2
3
3a
4
4a
5
6
7
8
9
10
11
13
14
15
16
18
19
20
21
22
23
24
25
P

METHOD AND MACHINE FOR GRINDING COATED SHEETS OF GLASS

The present invention relates to a machine for grinding sheets of glass, and in particular to a two-sided grinding machine, to which the following description refers purely by way of example.

BACKGROUND OF THE INVENTION

To grind the peripheral edge of a sheet of glass, two-sided machines are used, which normally comprise a conveyor for feeding the sheets forward in succession, and two grinding units located on opposite sides of the conveyor to simultaneously grind respective lateral portions of the sheet.

Though widely used, known machines of the above type cannot be used for grinding glass sheets of all types, and in particular coated glass sheets, which, as is known, call for removing one or more peripheral portions of the coating material to glue the coated sheet to another facing sheet of glass to form insulating windows.

SUMMARY OF THE INVENTION

It is an object of the present invention to provide a machine for grinding sheets of glass, designed to provide a straightforward, low-cost solution to the above problem.

According to the present invention, there is provided a machine for grinding a coated sheet of glass comprising a sheet of glass and a layer of coating material coating the sheet of glass; the machine comprising supporting means defining a supporting surface for the sheet of glass, and at least one grinding unit comprising at least one respective first grinding wheel to grind a portion of the peripheral edge of said sheet of glass; characterized in that said grinding unit also comprises a respective second grinding wheel having an abrasive surface facing, in use, an extensive surface of said coated sheet of glass, and having a generating line parallel to said supporting surface and to said extensive surface to remove a portion of said layer of coating material.

The present invention also relates to a method of grinding coated sheets of glass.

According to the present invention, there is provided a method of grinding a coated sheet of glass comprising a sheet of glass and a layer of coating material partly coating the sheet of glass; the method comprising a first grinding step to grind a peripheral edge of the sheet of glass; and a second grinding step to remove an elongated lateral portion of said layer of coating material; characterized in that said first and said second grinding step are performed simultaneously.

BRIEF DESCRIPTION OF THE DRAWINGS

A non-limiting embodiment of the invention will be described by way of example with reference to the accompanying drawings, in which.

DETAILED DESCRIPTION OF THE INVENTION

Figures 1, 2:
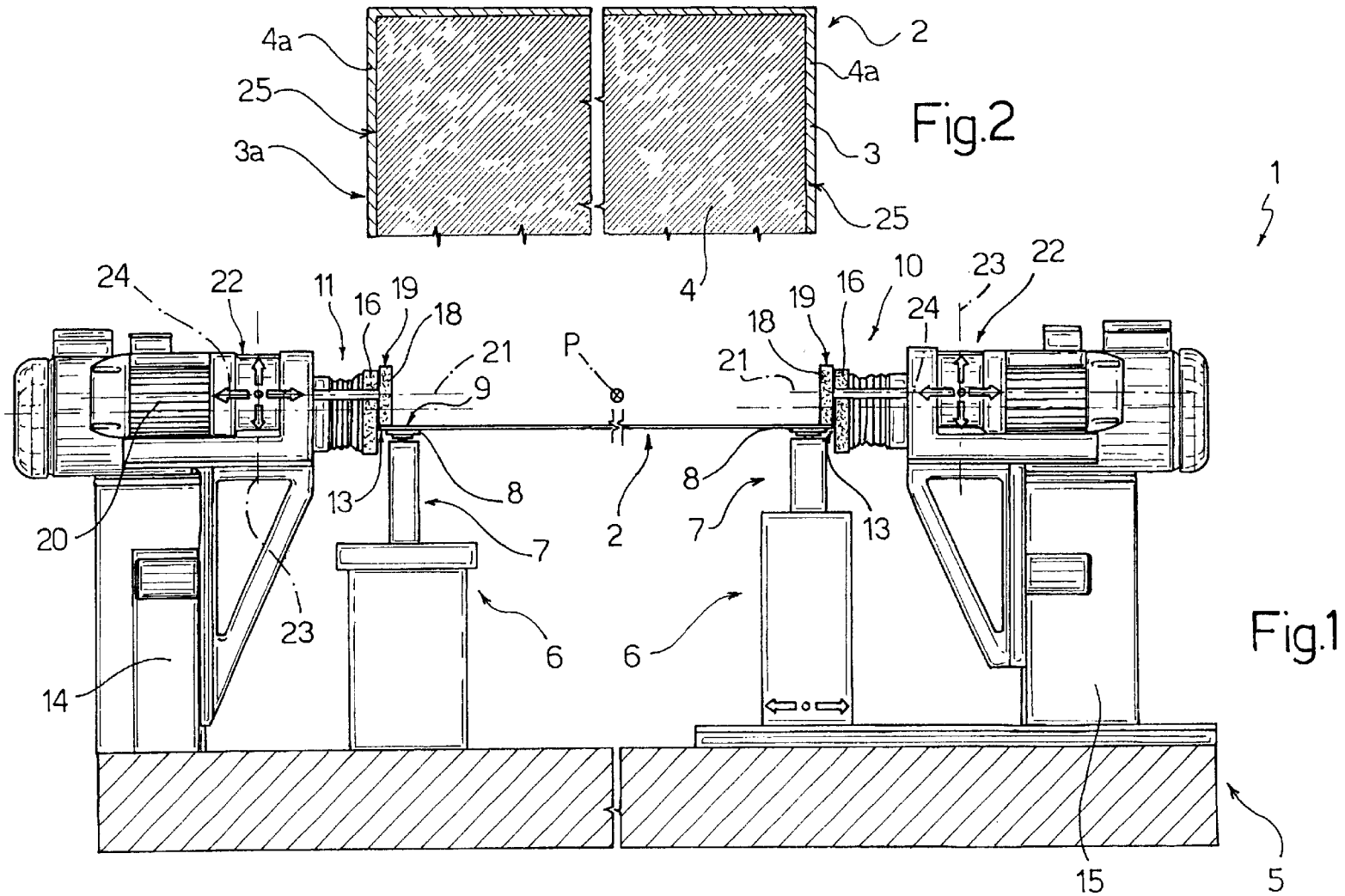
FIG. 1 shows partly, and substantially in block form, a preferred embodiment of the grinding machine according to the present invention.
FIG. 2 shows a sheet of glass ground on the FIG. 1 machine.

Number 1 in FIG. 1 indicates as a whole a two-sided grinding machine (shown partly) for grinding both ordinary sheets of glass as well as coated sheets 2 of glass defined by a sheet 3 of glass and a layer 4 of coating material coating an extensive surface of sheet 3.

Machine 1 comprises a frame 5; and a sheet supporting and conveying unit 6, in turn comprising two side by side belt conveyors 7 powered to feed sheets 2 along a grinding path indicated P in FIG. 1. More specifically, conveyors 7 have respective feed branches 8 defining a horizontal supporting surface 9 for sheet 3, and which are activated to releasably retain sheet 3, e.g. by suction, at least during a grinding process.

Machine 1 also comprises two grinding units 10 and 11 located on opposite sides of supporting and conveying unit 6 to simultaneously grind respective opposite lateral portions 13 of coated sheet 2. Unit 11 is supported on a fixed upright 14 of frame 5, while unit 10 is supported on a powered slide 15 connected to frame 5 in sliding manner to move unit 10 to and from unit 11 to adapt machine 1 to coated sheets 2 of different sizes for grinding.

Each grinding unit 10, 11 comprises one or more known grinding wheels 16—only one of which is shown in FIG. 1—positioned to grind sheet 3 of glass to size or bevel or polish the peripheral edge 3*a* of sheet 3 of glass.

Each grinding unit 10, 11 also comprises a further grinding wheel 18 for removing a peripheral portion 4*a* of layer 4 coating sheet 3 of glass. In the particular example shown, each grinding wheel 18 extends over supporting surface 9, is positioned facing layer 4, and is defined by a cylindrical abrasive surface 19, a generating line of which extends parallel to supporting surface 9. Each grinding wheel 18 is fitted to the output shaft of a respective electric motor 20 to rotate about a horizontal axis 21 parallel to supporting surface 9, and is adjustable in position with respect to supporting surface 9 by means of a known adjusting device 22, not described in detail, for moving respective grinding wheel 18, with respect to the rest of respective group 10, 11, in two perpendicular directions indicated 23 and 24.

In actual use, unit 6 feeds a coated sheet 2 of glass, positioned with coating layer 4 facing upwards, between units 10 and 11, which simultaneously grind respective portions 13 to grind the portions of edges 3*a* of sheet 3 by means of respective grinding wheels 16, and to remove, simultaneously with the grinding of edges 3*a*, the respective peripheral portions 4*a* of layer 4 by means of respective grinding wheels 18.

At the output of machine 1, sheet 2, now having two opposite lateral bands 25 with no coating material, is rotated 90° and fed again through machine 1, which, in the same way as before, grinds the other two opposite lateral portions 13 of the sheet.

Simply adding two grinding wheels to the existing grinding units on ordinary two-sided machines therefore provides, unlike known solutions, for removing peripheral portions of the coating layer of the sheet of glass while simultaneously grinding the peripheral edge of the sheet of glass in the normal way, thus ensuring, in particular, consistent relative positioning of the coated and decoated areas. The consistency of both the area for receiving the bonding material and its position with respect to the still-coated area provides for consistent quality of the end product, i.e. insulating windows, which therefore have no peripheral portions in which the coating material is interposed between the glass sheet and the bonding material, thus ensuring extremely stable, fluidtight connection of the glass sheets.

Using grinding wheels 18 operating simultaneously with each other and with the other grinding wheels on the machine greatly reduces machining cycle time and, therefore, production cost as compared with known solutions, by eliminating downtime, e.g. for transferring or repositioning the sheets between removal of the coating layer and grinding the peripheral edge of the sheet of glass.

Clearly, changes may be made to machine 1 as described herein without, however, departing from the scope of the accompanying claims.

In particular, each grinding unit 10, 11 may comprise more than one grinding wheel 18, which may rotate about an axis not necessarily horizontal or parallel to the sheet supporting surface. The sheet may be fed between units 10, 11 by devices other than those shown by way of example, or may be clamped at work stations; in which case, units 10 and 11 and respective grinding wheels 18 may be moved along the edge of the sheet for grinding.

Finally, machine 1 may comprise only one unit 10, 11, fixed or movable with respect to the sheet for grinding; and the relative grinding wheel 18 may be supported by a structure separate from and independent of that supporting the other grinding wheels.

What is claimed is:

1. A method of grinding a coated sheet of glass (2) comprising a sheet of glass (3) and a layer (4) of coating material partly coating the sheet of glass (3); the method comprising a first grinding step to grind a peripheral edge **(3*a*) of the sheet (3) of glass; and a second grinding step to remove an elongated lateral portion (4*a*) of said layer (4)** of coating material; characterized in that said first and said second grinding step are performed simultaneously.

2. A method as claimed in claim 1, characterized by comprising two grinding operations performed simultaneously and each on a respective peripheral portion (13) of said coated sheet of glass (2); each said grinding operation comprising said first and said second step.

3. A method as claimed in claim 2, characterized in that said peripheral portions (13) are opposite peripheral portions of said coated sheet of glass (2).

4. A machine (1) for grinding a coated sheet of glass (2) comprising a sheet of glass (3) and a layer (4) of coating material coating the sheet of glass (3); the machine (1) comprising supporting means (6) defining a supporting surface (9) for the sheet of glass (3), and at least one grinding unit (10; 11) comprising at least one respective first grinding wheel (16) to grind a portion **(3*a*) of the peripheral edge of said sheet of glass (3); characterized in that said grinding unit (10; 11) also comprises a respective second grinding wheel (18) having an abrasive surface (19) facing, in use, an extensive surface of said coated sheet of glass (2), and having a generating line parallel to said supporting surface (9) and to said extensive surface to remove a portion (4*a*) of said layer (4)** of coating material.

5. A machine as claimed in claim 4, characterized in that said second grinding wheel (18) rotates about a respective axis (21) parallel to said supporting surface (9).

6. A machine as claimed in claim 4, characterized in that said second grinding wheel (18) is located over said supporting surface (9) and said layer (4) of coating material.

7. A machine as claimed in claim 4, characterized by comprising adjusting means (22) for adjusting the position of said second grinding wheel (18) with respect to said supporting means (6).

8. A machine as claimed in claim 4, characterized by comprising a slide (15) supporting said grinding unit (10) and for moving the grinding unit (10) to and from said supporting means (6); said second grinding wheel (18) being carried by said slide (15).

9. A machine as claimed in claim 8, characterized by comprising at least one guide-slide assembly (22) interposed between said slide (15) and the respective second grinding wheel (18) to adjust the position of the second grinding wheel (18) with respect to the slide (15).

10. A machine as claimed in claim 4, characterized by comprising two said grinding units (10) (11) located on opposite sides of said supporting surface (9) to simultaneously grind different peripheral portions (13) of said coated sheet of glass (2); each grinding unit (10) (11) comprising a respective said second grinding wheel (18).

* * * * *